US007073529B1

(12) United States Patent
Harkey

(10) Patent No.: US 7,073,529 B1
(45) Date of Patent: Jul. 11, 2006

(54) RETRACTABLE GARDEN HOSE REEL

(76) Inventor: Eric Harkey, 4017 Albany, Lubbock, TX (US) 79424

( * ) Notice: Subject to any disclaimer, the term of this patent is extended or adjusted under 35 U.S.C. 154(b) by 0 days.

(21) Appl. No.: 11/161,807

(22) Filed: Aug. 17, 2005

(51) Int. Cl.
*B65H 75/34* (2006.01)

(52) U.S. Cl. ..... 137/355.23; 137/355.27; 242/371

(58) Field of Classification Search ..... 137/355.16, 137/355.23, 355.27; 242/371
See application file for complete search history.

(56) References Cited

U.S. PATENT DOCUMENTS

| | | | | | |
|---|---|---|---|---|---|
| 1,227,466 | A * | 5/1917 | McDowell | ..... | 137/355.21 |
| 1,537,637 | A * | 5/1925 | Jarvis | ..... | 137/355.12 |
| 1,675,140 | A * | 6/1928 | Schenderlein | ..... | 242/376.1 |
| 1,908,452 | A * | 5/1933 | Lea | ..... | 242/385.1 |
| 2,286,904 | A * | 6/1942 | Ewald | ..... | 137/355.26 |
| 4,543,982 | A * | 10/1985 | Wolfe | ..... | 137/355.21 |
| 4,813,627 | A | 3/1989 | Nelson | | |
| 4,974,627 | A | 12/1990 | Nelson | | |
| D321,123 | S | 10/1991 | Simonetti | | |
| D328,173 | S | 7/1992 | Nelson | | |
| 5,381,820 | A * | 1/1995 | Chandler | ..... | 137/355.23 |
| 5,381,981 | A | 1/1995 | Nelson | | |
| 5,520,212 | A * | 5/1996 | Williams | ..... | 137/355.23 |
| D404,286 | S | 1/1999 | Plantz et al. | | |
| 6,591,858 | B1 * | 7/2003 | Peterson | ..... | 137/355.23 |

* cited by examiner

*Primary Examiner*—A. Michael Chambers
(74) *Attorney, Agent, or Firm*—Theresa M. Seal

(57) ABSTRACT

A retractable garden hose reel that obviates the need for a hand crank to reel in the garden hose includes a pair of wheels pivotally mounted to a frame that includes a handle and a base with a reel shaft and a slide track extending between and interconnected to side frame members of the frame. An extendible and retractable garden hose is mounted on the reel shaft and enclosed within a housing unit adjacent one side frame member is a recoil spring concentric with the reel shaft and having one end attached to the reel shaft and an opposite end secured within the housing unit so that extension of the garden hose winds the recoil spring and retraction of the garden hose occurs when a lock and release mechanism disengages from a sprocket interconnected to the reel shaft and the recoil spring thereby allowing the recoil spring to simultaneously unwind and retract the garden hose.

15 Claims, 6 Drawing Sheets

RETRACTABLE GARDEN HOSE REEL

The present invention pertains to garden hose reels and caddies, and more particularly pertains to a garden hose reel wherein a recoil spring is employed for the retraction of the garden hose mounted on a reel shaft with the recoil spring concentrically mounted to the reel shaft.

BACKGROUND OF THE INVENTION

Portable garden hose reel carts and caddies are quite popular among both residential homeowners and commercial and industrial users in so far as they allow the individual to easily and quickly maneuver the garden hose to various locations about a home or site by avoiding the hassle of dragging or carrying the garden hose. However, after the garden hose is used to discharge water onto lawns, vehicles, decks, siding, gardens, tools, etc., the hose must be rewrapped on the caddy where the hose is stored for future use. Generally, a simple hand crank interconnected to the shaft on which the garden hose is mounted is manually rotated for reeling in the garden hose. While this may not seem a difficult task, some garden hose carts support up to 200 feet of garden hose, and not everyone can easily reel in this amount of garden hose. Therefore, various types of mechanisms have been designed to facilitate the reeling in of garden hoses supported on portable carts and caddies.

For example, the Nelson patent (U.S. Pat. No. 4,813,627) discloses a rewindable hose reel that includes a flat coil spring that is selectively wound and unwound on and off of a spring tensioning spool that includes a ratchet pawl assembly for locking the unwound spring in position during hose unreeling and for releasing the coil spring to wind in the garden hose.

The Nelson patent (U.S. Pat. No. 4,974,627) discloses a garden hose reel caddy having a hose reel mounted adjacent the ground and a gear drive mechanism that allows for the elevated mounting of the hand crank so that the user does not have to stoop to reel and unreel the garden hose.

The Simonetti patent (U.S. design Pat. 321,123) discloses the design for a hose reel cart that includes a single wheel, opposed side frame members between which the garden hose is mounted, and a pair of upwardly extending handles spaced from each other and attached to each side frame member.

The Nelson patent (U.S. design Pat. 328,173) discloses the design for a garden hose reel cart that includes an elevated hand crank and wheels that are disposed in non-contacting relationship to the ground when the cart is at rest.

The Plantz et al. patent (U.S. design Pat. 404,286) discloses the design for a garden hose reel that includes a drum or barrel-shaped housing for the garden hose, and a handle to transport the garden hose reel.

The Nelson patent (U.S. Pat. No. 5,381,981) discloses a garden hose reel that includes left and right halves that are joined together by interlocking structures that include screw fasteners that distribute the torque forces, with the conjoined halves having inwardly tapering hose support surfaces that keep the garden hose centered on the hose reel.

Nonetheless, despite the ingenuity of the above devices, there remains a need for a garden hose reel wherein the garden hose is easily and quickly retractable without the need of employing a cumbersome hand crank.

SUMMARY OF THE INVENTION

The present invention comprehends a lightweight, portable retractable garden hose reel wherein the retraction of the garden hose results from the released energy of a recoil spring as the recoil spring goes from a wound state to an unwound state. More specifically, the retractable garden hose reel includes a frame that comprises a base for supporting the garden hose reel on a ground surface, a handle, and a pair of opposed side frame members each of which is pivotally mounted to a wheel that allows for the movement and positioning of the garden hose reel at a site or from site and site. Extending between the side frame members, and integrally attached thereto, is a slide track, and beneath the slide track is a reel shaft interconnected to the side frame members. A garden hose is mounted on the reel shaft and is payed out and reeled in through the outlet or aperture of a screw clamp housing unit that is slidably mounted on the slide track. The retraction mechanism for automatically retracting the garden hose includes a recoil spring that is enclosed within a housing and has one end secured to the housing and an inner end secured to the reel shaft. Thus, as the garden hose is payed out for use the recoil spring winds upon the reel shaft and is then locked in position by the engagement of a stop mechanism to a sprocket that is interconnected to, and rotates concomitant with, the reel shaft. The sprocket is released by a manually operable button or switch mounted to the side frame member adjacent the housing for the recoil spring, and release of the sprocket allows the recoil spring to unwind within the housing thereby rotating the reel shaft and retracting the garden hose. An attachment at the discharge end of the garden hose prevents the garden hose from being drawn rearward through the outlet of the slidably mounted screw clamp housing unit.

It is an objective of the present invention to provide a retractable garden hose reel that eliminates the use of a hand crank to reel in a garden hose after the hose has been payed out from the reel shaft of the garden hose.

It is another objective of the present invention to provide a retractable garden hose reel that includes a retraction mechanism for reeling in at least 200 feet of garden hose without using a hand crank.

It is yet another objective of the present invention to provide a retractable garden hose reel that includes structural components that prevent the over retraction of the garden hose.

It is still yet another objective of the present invention to provide a retractable garden hose that quickly and easily retracts the garden hose.

Still yet another objective of the present invention is to provide a retractable garden hose reel that is sturdily constructed with off-the-shelf items and is able to withstand repeated use.

Still yet a further objective of the present invention is to provide a retractable garden hose reel that is portable and can also be wall mounted.

These and other objects, features and advantages will become apparent to those skilled in the art upon a perusal of the following detailed description read in conjunction with accompanying drawing figures and appended claims.

DETAILED DESCRIPTION OF THE PREFERRED EMBODIMENT

Figure 1:
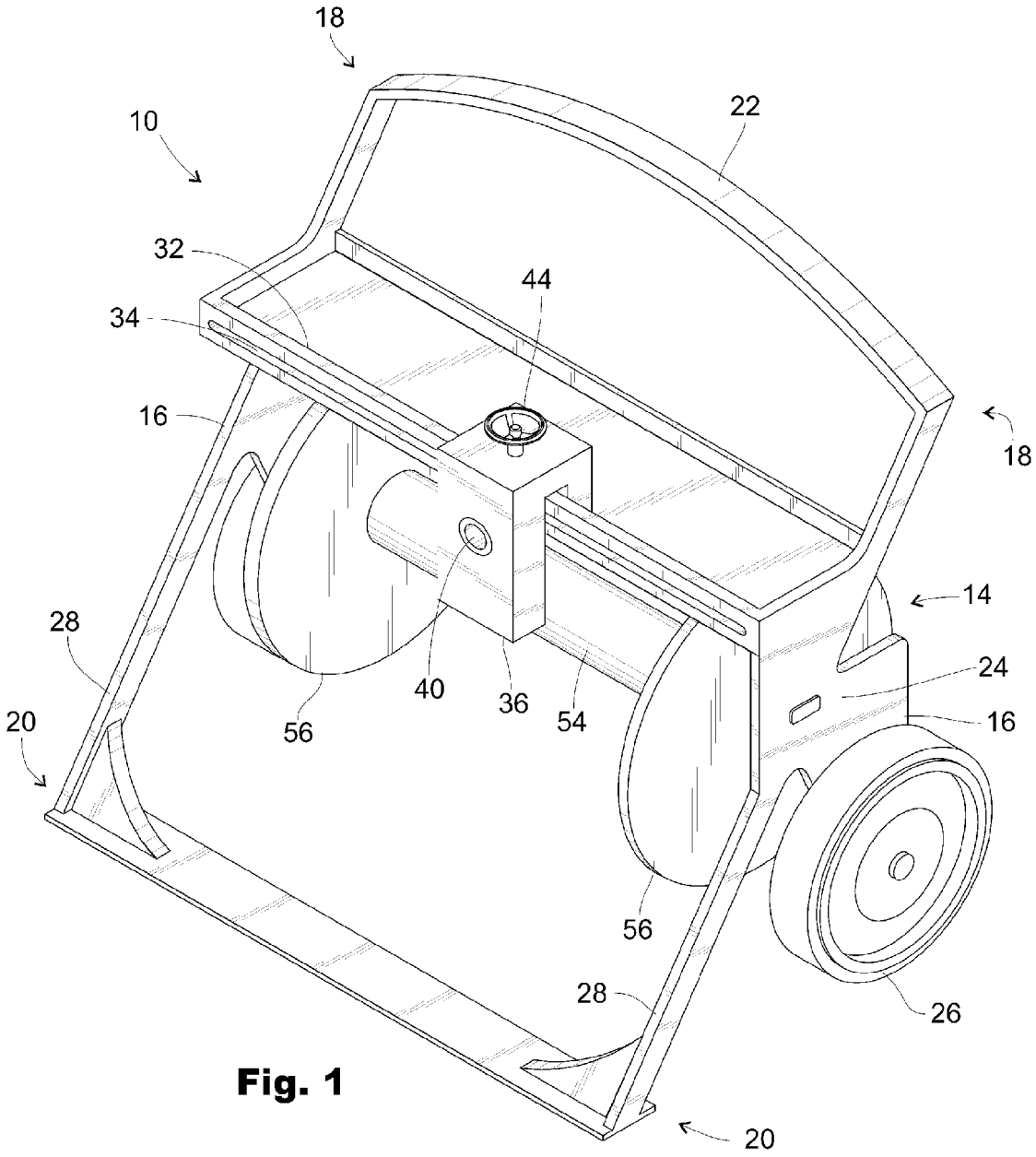
FIG. 1 is a perspective view of the retractable garden hose reel of the present invention illustrating the primary structural components of the garden hose reel but without showing the disposition of the garden hose on the reel shaft.

Illustrated in FIGS. 1–8 is a lightweight, portable retractable garden hose reel 10 that allows the homeowner or business owner to retract a garden hose 12 mounted thereon without the need of a manually operable hand crank. The present invention allows the user to easily and effortlessly retract approximately 200 feet of extended garden hose by merely pressing a button or switch on the garden hose reel 10 and then standing beside the device to simply monitor the progress of the garden hose retraction.

Thus, shown in FIGS. 1–8 is the portable and retractable garden hose reel 10 that includes frame or carriage 14 preferably constructed of a hard, durable, easy to clean plastic material. The frame 14 further includes a pair of spaced-apart side frame members 16 that define each side of the garden hose reel 10. Each side frame member 16 includes an upper end 18 and an opposite lower end 20, and extending between and attached to the upper ends 18 of the side frame members 16 is a handle 22 that can be easily grasped by the individual for moving and maneuvering the garden hose reel 10 about a site or from site to site. Pivotally mounted to the body portion 24 of each side frame member 16 is a wheel 26, and the pivotal mounting of the side frame members 16 to the wheels 26 allows the user to tip or tilt the garden hose reel 10 to more easily move and maneuver about the garden hose reel 10. In addition, as shown in FIGS. 1, 2, 5 and 6, extending downwardly at an angle from the body portion 24 of each side frame member 16 is a support leg 28. A base 30 extends between and is attached to the bottom of each support leg 28. The base 30 provides a stable and balanced supporting surface for the garden hose reel 10.

Figure 2:
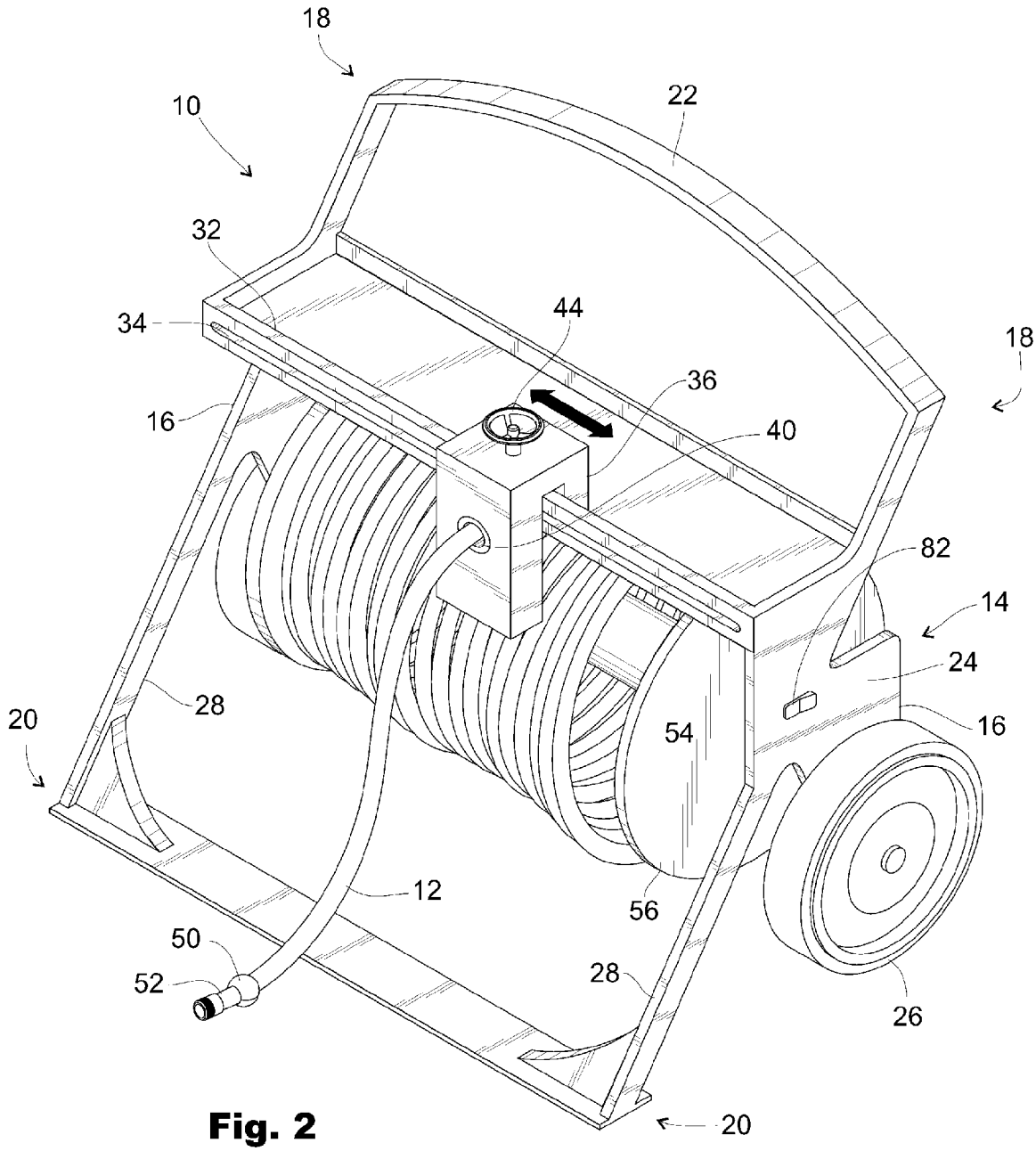
FIG. 2 is a perspective view of the retractable garden hose reel of the present invention illustrating the disposition of the garden hose on the reel shaft when the garden hose is in the fully wound, non-use state.
Figure 3:
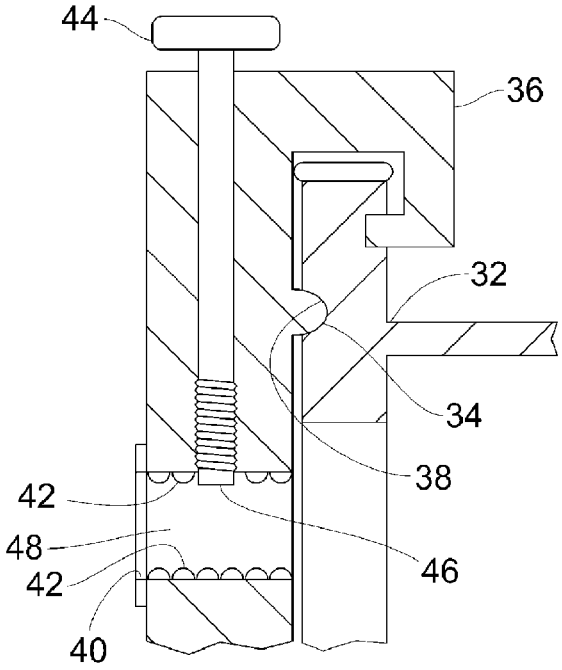
FIG. 3 is a sectioned elevational view of the retractable garden hose reel of the present invention illustrating the interconnection of the screw clamp with the slide track and the aperture through which the garden hose is payed out from and reeled in upon the reel shaft.
Figure 5:
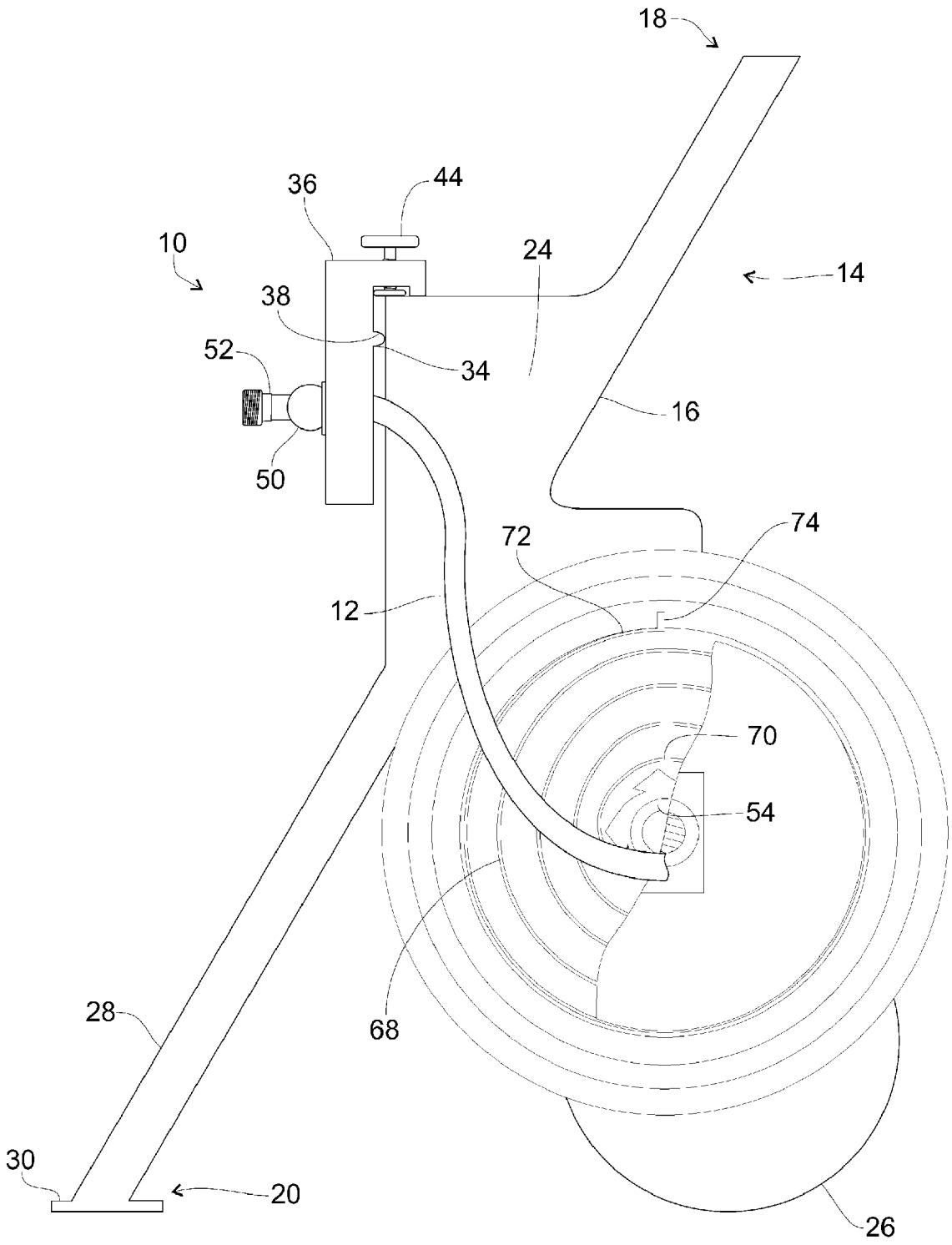
FIG. 5 is a sectioned side elevational view of the retractable garden hose reel of the present invention illustrating the disposition of the recoil spring within a housing unit when the garden hose is in the wound and non-use state.
Figure 6:
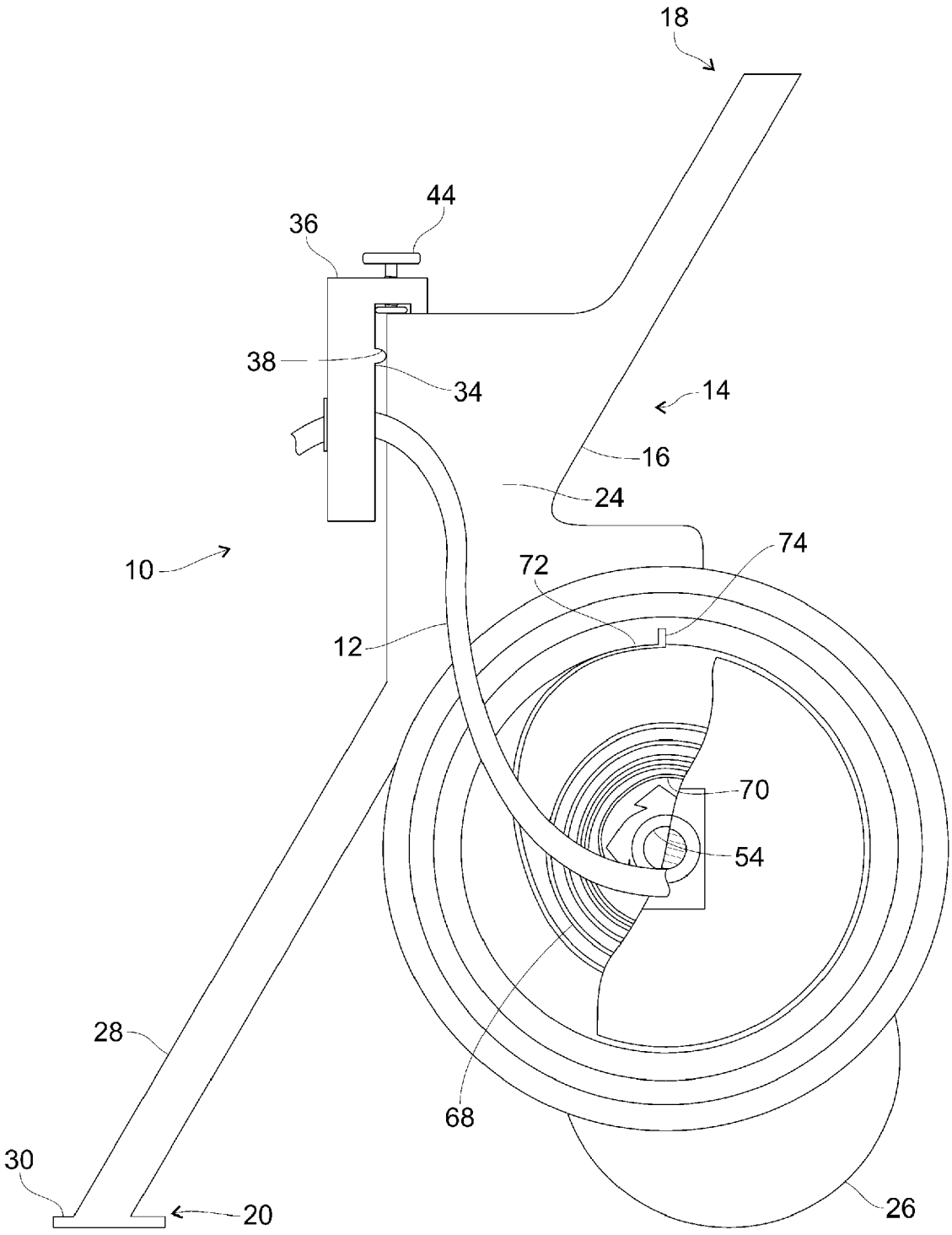
FIG. 6 is a sectioned elevational view of the retractable garden hose reel of the present invention illustrating the disposition of the recoil spring within the housing unit when the garden hose is being unwound and reeled out for use.

As shown in FIGS. 1, 2, 3, 5 and 6, a slide track or bar 32 extends between and is mounted to the body portions 24 of the side frame members 16. The slide track or bar 32 includes a slide track groove 34 that is generally coequal in length with the slide track 32 and faces or opens up to the front of the device 10. Mounted on the slide track 32 and engaging the slide track groove 34 is a screw clamp housing unit 36. The screw clamp housing unit 36 is capable of slidable reciprocable movement along the slide track 32 and slides between the side frame members 16. As shown most clearly in FIG. 3, the screw clamp housing unit 36 is an I-shaped piece having an inwardly disposed projection or nubbin 38 that fits into the slide track groove 34 and facilitates the slidable movement of the screw clamp housing unit 36 on the slide track 32. The screw clamp housing unit 36 also includes an aperture or outlet 40 through which the garden hose 12 is both payed out and retracted and reeled in. The cylindrical surface that defines the outlet 40 includes slide track rollers 42, and these rollers 42 can be circumjacent mounted about the outlet 40 to facilitate the movement of the garden hose 12 through the outlet 40 by lessening or minimizing the resistance of the surface of the outlet 40 against the garden hose 12. In order to control the recoil or retraction speed of the garden hose 12, the screw clamp housing unit 36 includes a manually adjustable screw clamp 44 that extends downwardly through the body of the screw clamp housing unit 36 and includes an end or tip 46 that registers with and can be slightly projected into the outlet 40. The tip 46 of the screw clamp 44 can be brought into abutting resistive contact with the surface of the garden hose 12, and adjusting the depth that the tip 46 extends into the outlet 40 determines the amount of resistive contact the tip 46 obtains with respect to the garden hose 12 and thus determines the velocity of garden hose 12 recoil. The tip 46 of the screw clamp 44 only needs to project a very slight distance into the bore 48 of the outlet 44 to resistively contact, dissipate and slow down the recoil speed of the garden hose 12. The screw clamp 44 thus prevents the uncontrolled retraction of the garden hose 12 that could possibly damage the garden hose reel 10 or injure someone—including the user—standing nearby. In addition, as illustrated in FIGS. 2 and 6, a clamp-on ball attachment 50 is affixed to the end 52 of the garden hose 12 to delimit the retraction of the garden hose 12 and to prevent the garden hose 12 from being completely withdrawn through the outlet 40 and the screw clamp housing unit 36. The screw clamp housing unit 36 also facilitates the general extension and retraction of the garden hose 12 because as the garden hose 12 is extended or retracted there will be some sideways movement, and this sideways or lateral movement is both coincident with and confined by the screw clamp housing unit 36. Thus, a smooth extension and retraction of the garden hose 12 can occur thereby avoiding the binding or tangling of the garden hose 12 in the area adjacent the slide track 32 and reel shaft 54.

Figure 4:
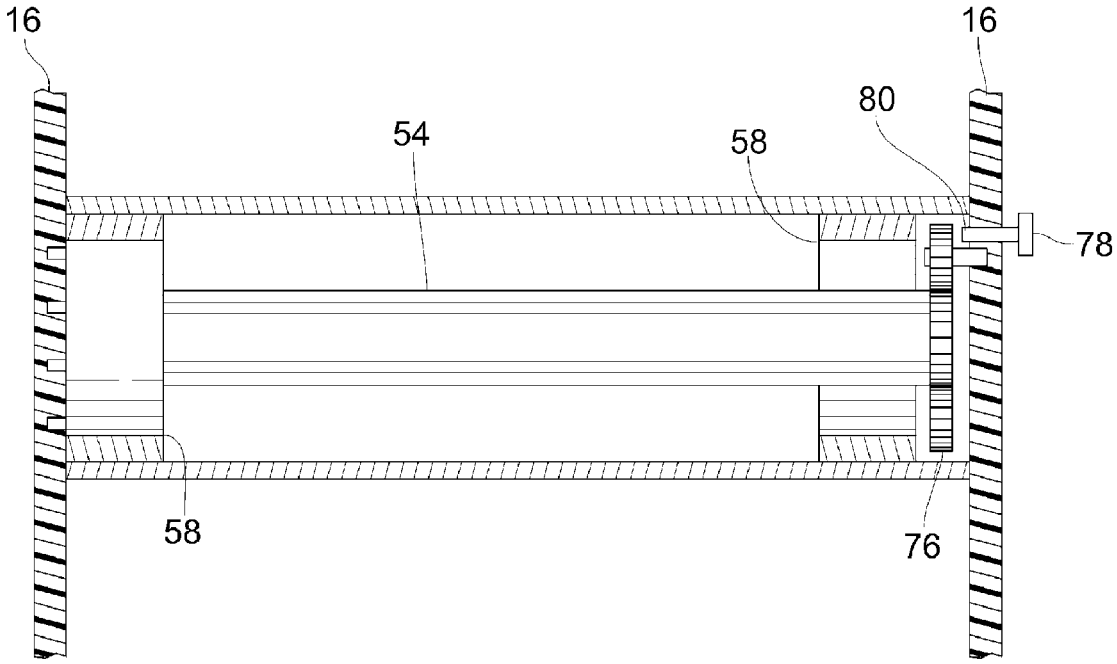
FIG. 4 is a sectioned elevational view of the retractable garden hose reel of the present invention illustrating the disposition of the reel shaft, sprocket, and mechanism to release and lock the sprocket so that the garden hose can be reeled in or unwound for use.

Illustrated in FIGS. 1, 2 and 4–8 is the flexible garden hose 12 and the rotatable reel shaft 54 on which the garden hose 12 is mounted for the selective unwinding and reeling out and selective winding and reeling in of the garden hose 12. The reel shaft 54 is disposed beneath the slide track 32 and is rotatably supported between the body portions 24 of the side frame members 16 by being interconnected to, for example, spools 56 one of which is disposed immediately inboard of the body portion 24 of each respective side frame member 16. FIG. 4 shows the reel shaft 54 mounted to and journaled on bushings or bearing blocks 58 as an alternative mounting means.

Figure 7:
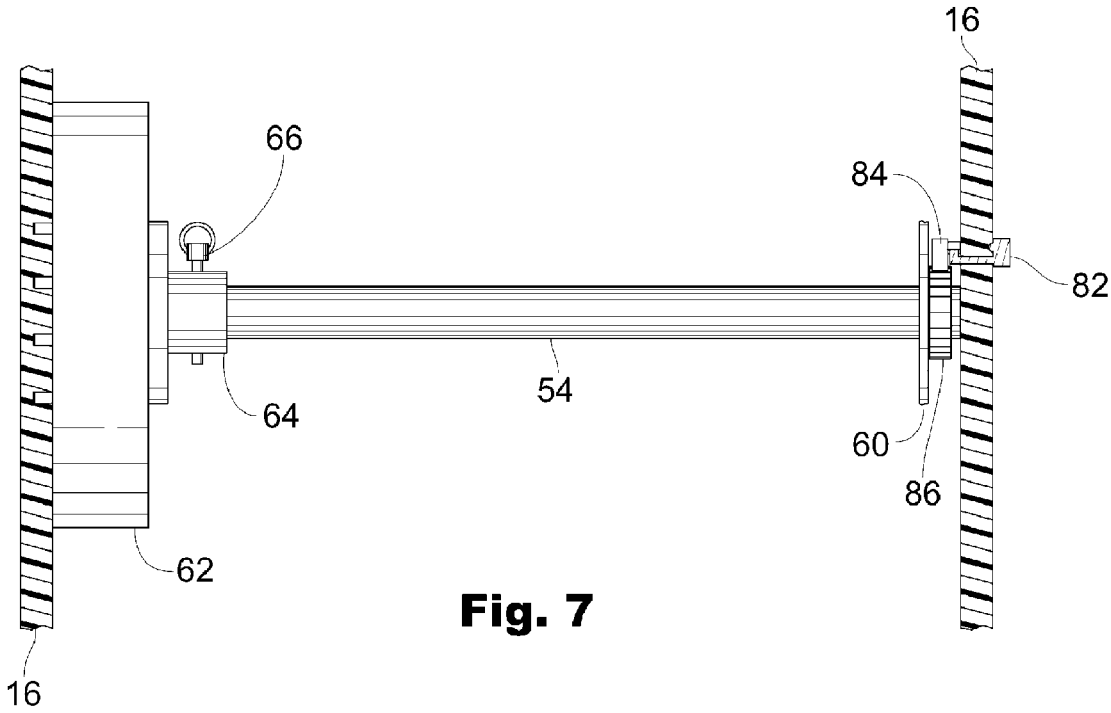
FIG. 7 is an enlarged sectioned view of the retractable garden hose reel of the present invention illustrating one embodiment of a locking and release mechanism for the garden hose.
Figure 8:
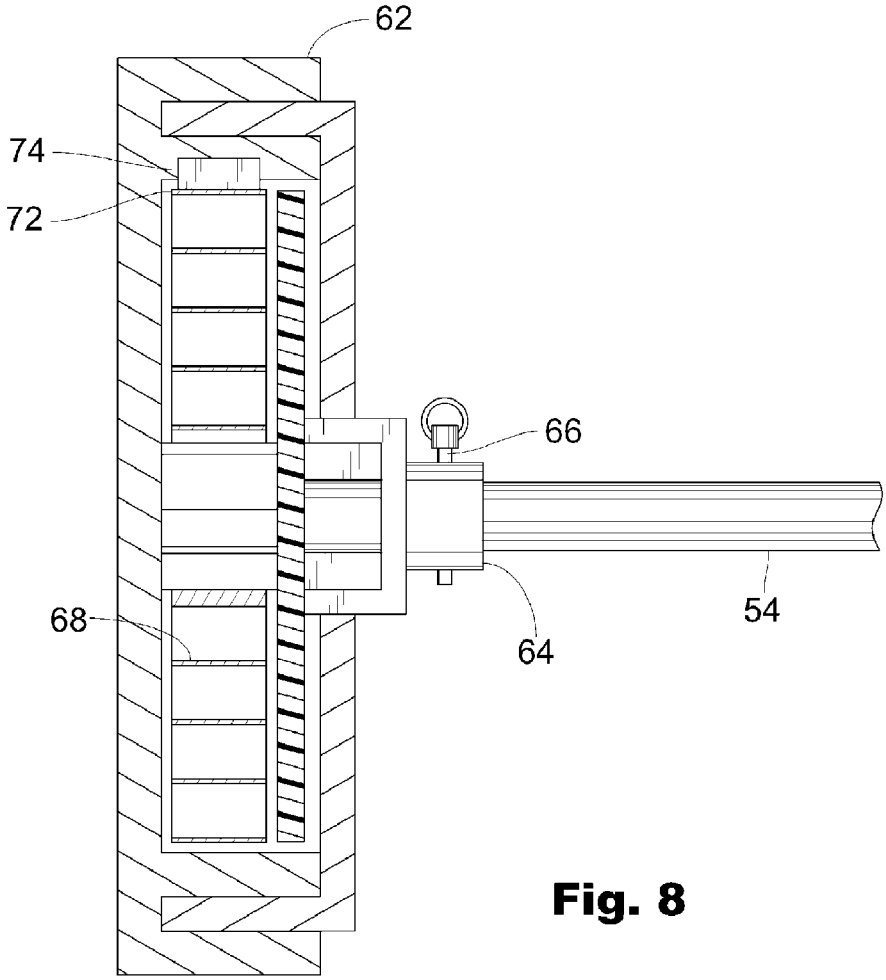
FIG. 8 is an enlarged sectioned view of the retractable garden hose reel of the present invention illustrating the disposition of the recoil spring within the recoil spring housing and the interconnection of the reel shaft to the recoil spring housing unit.

FIGS. 7 and 8 illustrate a second embodiment for rotatably mounting the reel shaft 54 to the side frame members 16. In FIG. 7 one end of the reel shaft 54 is mounted to a disc-shaped spool 60 for interconnection to that side frame member 16, with the reel shaft 54 slightly extending through and past the spool 60. Mounted inboard on the opposite side frame member 16 is a recoil spring housing unit 62. A bushing 64 inwardly projects from the recoil spring housing unit 62 and is axially aligned with the opposite disc-shaped spool 60. The end of the reel shaft 54 is inserted into the bushing 64 and a locking pin 66 is then inserted through the bushing 64 and the end of the reel shaft 54 thereby fixing the reel shaft 54 to the bushing 64, and, further, to that side frame member 16. The attachable and detachable securement of the reel shaft 54 to the bushing 64 allows for maintenance, repair, and, with respect to the garden hose 12, its replacement if necessary without fully disassembling the garden hose reel 10.

In order to retract the garden hose 12 without using a manual hand crank, the present invention includes a means to retract the garden hose 12 that is interconnected to the reel shaft 54 and the recoil spring housing unit 62. More specifically, as shown in FIGS. 5, 6 and 8, the garden hose retraction means includes a flexible metal recoil spring 68 that is enclosed within the recoil spring housing unit 62 and thus protected from external damage. The recoil spring 68 has an inner end 70 that is attached to the reel shaft 54 by at least one roll pin and an outer end 72 attached to the recoil spring housing unit 62 also by at least one roll pin 74. The roll pins 74 provide durability of securement so that the recoil spring 68 can uncoil and recoil numerous times without the ends 70 and 72 of the recoil spring 68 being worn away from or breaking or tearing away from their securement to the reel shaft 54 and the recoil spring housing unit 62. The recoil spring 68 is coaxially mounted with respect to the reel shaft 54, and is actually constrained in its expansion and contraction by enclosure within the recoil spring housing unit 62. The recoil spring 68 is of such a composition and configuration that it stores energy as it is being wound upon a portion of the reel shaft 54 coincident with the extension of the garden hose 12, and this stored energy has sufficient force upon release of the recoil spring 68 to retract the garden hose 12 even if the garden hose 12 is extended 200 feet. FIG. 5 illustrates the recoil spring 68 in its wound state during garden hose 12 extension and FIG. 6 illustrates the recoil spring 68 in its fully unwound state concomitant with the retraction of the garden hose 12. The disposition of the clamp-on ball attachment 50 against the face of the outlet 40 of the screw clamp housing unit 36 prevents the withdrawal of the end 52 of the garden hose 12 rearward through the screw clamp housing unit 36 as is also clearly shown in FIG. 6. The natural state of the recoil spring 68 is in the unwound, relaxed state shown in FIG. 6 so that as the recoil spring 68 goes from the wound state of FIG. 5 to the unwound state of FIG. 6, it simultaneously rotates the reel shaft 54 to which it is attached at the inner end 70 thereby rotating the reel shaft 54 and reeling in the garden hose 12 that is mounted upon the reel shaft 54.

Upon unwinding and extending the garden hose 12 the desired distance a means must be provided to lock the garden hose 12 and the recoil spring 68 in position until it is time to reel in the garden hose 12. Thus, the present invention includes a garden hose lock and release means that allows the garden hose 12 to be unwound to the desired distance, locked in position, and then unlocked for retraction and reeling in through the action of the reel shaft 54 and recoil spring 68. FIGS. 4, 7 and 8 include several embodiments for the garden hose lock and release extension and retraction means. In FIG. 4, a sprocket 76 is mounted at one end of the reel shaft 54 for rotation coincident therewith. A manually operable switch or button 78 is mounted on the exterior surface of the side frame member 16 and includes a stop 80 that extends into and through the side frame member 16 for selective engagement to and disengagement from the sprocket 76. Thus, extension of the stop 80 causes the stop 80 to engage the sprocket 76 and holds the recoil spring 68 in its unwound state and locks the garden hose 12 in its extended position. This action also prevents any rotation of the reel shaft 54. Disengagement of the stop 80 from the sprocket 76 immediately allows the recoil spring 68 to unwind within the recoil spring housing unit 62 and also simultaneously causes the rotation of the reel shaft 54 thereupon causing the retraction of the garden hose 12.

FIG. 7 illustrates a second embodiment for locking the garden hose 12 in position after the desired extension has been obtained, and then for releasing the recoil spring 68 so that the recoil spring 68 can unwind and retract the garden hose 12. A slidable button or switch 82 is mounted on to one side frame member 16 for movement between an off—disengaged—state that allows for garden hose 12 movement—that is, extension and retraction, and an on—engaged—state that locks the recoil spring 68 in position after obtaining the desired extension of the garden hose 12. A stop 84 (which can be spring-loaded) is interconnected to the slidable switch 82 and is brought into engagement with a sprocket 86 when the switch 82 is moved to the on position, and the stop 84 is disengaged from the sprocket 86 when the switch 82 is moved to the off position. Engagement of the sprocket 86 by the stop 84 prevents rotation of the sprocket 86, the reel shaft 54, and the further coiling or winding of the recoil spring 68; while disengagement of the stop 84 from the sprocket 86 resulting from sliding the switch 82 to the off position immediately releases the recoil spring 68 for unwinding within the housing unit 62 and thus causes the simultaneous rotation of the reel shaft 54 and the retraction of the garden hose 12.

Although this invention has been described in detail with particular reference to certain preferred embodiments, it will be apparent to those skilled in the art the numerous alterations, modifications, and variations are both possible and practicable while still remaining with the spirit of the invention and the scope of the appended claims.

What is claimed is:

1. A retractable garden hose reel for retracting a garden hose after the garden hose has been reeled out for use, comprising:

a pair of opposed side frame members with each side frame member having an upper end and an opposite lower end;

a handle extending between and attached to the upper ends of the side frame members;

a base for supporting the garden hose reel on a ground surface, the base extending between and attached to the lower ends of the side frame members;

a rotatable reel shaft extending between and interconnected to the side frame members;

the garden hose disposed on the reel shaft and capable of selective extension from the reel shaft and retraction upon the reel shaft;

a slide track mounted to and extending between the side frame members with the slide track being positioned above reel shaft;

a screw clamp housing unit mounted on the slide track for slidable reciprocable movement thereon and having an outlet through which the garden hose passes during extension and retraction with the slidable movement of the screw clamp housing unit coincident with the extension and retraction of the garden hose;

a recoil spring housing unit mounted inboard and against one side frame member and through which a portion of the reel shaft extends;

a recoil spring enclosed within the recoil spring housing unit and coaxially interconnected to the reel shaft and the recoil spring housing unit so that the recoil spring can wind and unwind concomitant with the rotation of the reel shaft to allow for the extension and retraction of the garden hose; and a garden hose lock and release means mounted to one side frame member for locking the recoil spring and the reel shaft in position and preventing rotation of the reel shaft after the desired extension of the garden hose has been obtained and for releasing the recoil spring and reel shaft so that the recoil spring can unwind within the recoil spring housing unit and rotate the reel shaft thereby causing the retraction of the garden hose.

2. The retractable garden hose reel of claim 1 wherein the slide track includes a slide track groove coequal in length with the slide track.

3. The retractable garden hose reel of claim 2 wherein the screw clamp housing unit includes a projection that fits into the slide track groove and facilitates the slidable movement of the screw clamp housing unit on the slide track.

4. The retractable garden hose reel of claim 1 further comprising an adjustable screw clamp that extends downwardly through the screw clamp housing unit for registration with the outlet and resistive contact against the garden hose for controlling the speed of extension and retraction of the garden hose through the outlet of the screw clamp housing unit.

5. The retractable garden hose reel of claim 4 wherein the garden hose lock and release means includes a sprocket mounted to the reel shaft opposite of the mounting of the recoil spring housing unit and inboard and adjacent to the respective side frame member.

6. The retractable garden hose reel of claim 5 wherein the garden hose lock and release means includes a slidable switch mounted outboard on the side frame member and opposite of the sprocket with the switch capable of slidable movement between an off position for allowing garden hose extension and retraction and an on position that prevents recoil spring winding and unwinding and reel shaft rotation thereby locking in position the garden hose.

7. The retractable garden hose reel of claim 6 further comprising a pair of wheels with each wheel pivotally mounted to the lower end of each respective side frame member thereby providing for the portability of the garden hose reel from site to site.

8. A retractable garden hose reel for automatically retracting a garden hose after the garden hose has been reeled out for use, comprising:

a frame having a pair of opposed side frame members, a handle extending between and attached to the side frame members, and a base extending between and attached to the side frame members for disposition on the ground surface a rotatable reel shaft extending between and interconnected to the side frame members;

the garden hose being disposed upon the reel shaft for selective extension from the reel shaft and selective retraction upon the reel shaft;

a slide track mounted to and extending between the side frame members with the slide track being positioned above the reel shaft;

a screw clamp housing unit mounted to the slide track for slidable movement thereon, the screw clamp housing unit having an outlet through which the garden hose passes during extension and retraction with the slidable movement of the screw clamp housing unit being coincident with the extension and retraction of the garden hose;

a recoil spring housing unit mounted inboard and against one side frame member and through which a portion of the reel shaft extends;

a recoil spring enclosed within the recoil spring housing unit and coaxially interconnected to the reel shaft and the recoil spring housing unit so that recoil spring winds and unwinds concomitant with the rotation of the reel shaft and the extension and retraction of the garden hose; and a garden hose lock and release means mounted to one side frame member for locking the recoil spring and the reel shaft in position to prevent rotation of the reel shaft after the desired extension of the garden hose has been obtained and for releasing the recoil spring and the reel shaft thereby allowing the recoil spring to unwind within the recoil spring housing unit and resulting in the rotation of the reel shaft and the retraction of the garden hose.

9. The retractable garden hose reel of claim 8 wherein the slide track includes a slide track groove generally coequal in length with the slide track.

10. The retractable garden hose reel of claim 9 wherein the screw clamp housing unit includes a projection that fits into the slide track groove and facilitates the slidable movement of the screw clamp housing unit on the slide track.

11. The retractable garden hose reel of claim 10 further comprising an adjustable screw clamp that extends downwardly into and through the screw clamp housing unit for registration with the outlet and capable of being brought into resistive contact with the garden hose for controlling the speed of garden hose extension and retraction through the outlet of the screw clamp housing unit.

12. The retractable garden hose reel of claim 11 wherein the garden hose lock and release means includes a sprocket interconnected to the reel shaft and that is mounted opposite of the recoil spring inboard and adjacent to that respective side frame member.

13. The retractable garden hose reel of claim 12 wherein the garden hose lock and release means includes a slidable switch mounted outboard onto the side frame member that the sprocket is mounted inboard of with the switch capable of slidable movement between an off position for allowing garden hose extension and retraction and an on position that locks the sprocket and thus prevents rotation of the reel shaft and winding and unwinding of the recoil spring and thereby maintaining the position of the garden hose.

14. The retractable garden hose reel of claim 13 further comprising a clamp-on ball attachment for attachment to the garden hose in order to prevent the retraction of the garden hose rearwardly through the outlet of the screw clamp housing unit.

15. The retractable garden hose reel of claim 14 further comprising a plurality of slide track rollers mounted within the outlet for contacting and facilitating the slidable movement of the garden hose through the outlet during garden hose extension and retraction.

* * * * *